US007326076B2

(12) United States Patent
Wu

(10) Patent No.: US 7,326,076 B2
(45) Date of Patent: Feb. 5, 2008

(54) RIGHT ANGLE CABLE ASSEMBLY HAVING LOCKING MEMBER ON OPPOSITE SIDES THEREOF

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,379

(22) Filed: Jul. 3, 2006

(65) Prior Publication Data

US 2006/0252296 A1 Nov. 9, 2006

Related U.S. Application Data

(63) Continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/354

(58) Field of Classification Search ..... 439/354, 439/344, 352, 357, 358
See application file for complete search history.

(56) References Cited

U.S. PATENT DOCUMENTS 5,213,533 A 5/1993 Walden
5,727,963 A 3/1998 Lemaster
5,775,931 A 7/1998 Jones
5,860,826 A 1/1999 Chang
5,941,726 A 8/1999 Koegel et al.
6,099,339 A 8/2000 Yanagida et al.
6,210,202 B1 4/2001 Kuo
6,558,183 B1 5/2003 Ji et al.
6,565,383 B1 5/2003 Wu
6,585,536 B1 7/2003 Wu
6,585,537 B1 7/2003 Lee
6,641,425 B1 * 11/2003 Wu ..... 439/352
6,648,665 B1 * 11/2003 Wu ..... 439/352
6,648,666 B1 * 11/2003 Wu ..... 439/352
6,702,603 B2 * 3/2004 Wu ..... 439/352
6,773,293 B1 * 8/2004 Lee ..... 439/357
6,786,755 B2 9/2004 Dambach et al.
6,945,807 B1 * 9/2005 Wu ..... 439/354

* cited by examiner

*Primary Examiner*—Chandrika Prasad
(74) *Attorney, Agent, or Firm*—Wei Te Chung

(57) ABSTRACT

A cable assembly (1) includes an insulative housing (10), a number of contacts (20) disposed in the housing, an insulator (70) with a base (71) and a distal portion (72) extending upwardly from the base, a plurality of cables (40), and a cover (50), the cables comprises a plurality of conductors (43) received in the distal portion of the insulator, passing through the base and connected to a rear portion of the housing, the cover assembled on the rear portion of the housing, enclosing insulator, and has a body portion (510), and a receiving portion (511) behind the body portion, the base of the insulator are received of in the body portion, and the distal portion of the insulator are received in the receiving portion, said cables extend out of the cover from a lateral side thereof.

16 Claims, 11 Drawing Sheets

RIGHT ANGLE CABLE ASSEMBLY HAVING LOCKING MEMBER ON OPPOSITE SIDES THEREOF

CROSS-REFERENCE

This is related to U.S. patent application Ser. No. 10/787,661, filed on Feb. 25, 2004 now U.S. Pat. No. 6,991,487 and entitled "CABLE CONNECTOR ASSEMBLY HAVING LOCKING MEMBER" which have the same applicant and assignee as the present invention.

BACKGROUND OF THE INVENTION

1. Field of the Invention

The present invention relates to a cable assembly, and particularly to a cable assembly having a locking member for locking with a complementary connector.

2. Description of Prior Arts

There exists in the art a cable assembly known as a Serial Advanced Technology Attachment (Serial ATA) connector which is generally used for disk drives and storage peripherals. Especially, the Serial ATA connectors according to the Serial ATA standard are featured in fewer counts of electrical contacts than other conventional electrical connectors and are relatively tiny in configuration. It is desirable for the Serial ATA connector to have latch means for providing a reliable mechanical and electrical connection with a complementary connector.

With the development of the Serial ATA standard, the next-generation serial storage interface effort expands the base Serial ATA 1.0 capabilities to address additional markets segments, including the server and networked storage markets. A cable assembly based on Serial ATA II standard is designed to connect with more devices and cables. As the connector is probably applied to a wider profile, an improved locking member of the Serial ATA connector is disclosed (U.S. patent application Ser. No. 10/787,661).

Obviously, it is desirable to improve the structure for retaining the improved locking member on a right angle electrical connector.

SUMMARY OF THE INVENTION

An object of the present invention is to provide a cable assembly having an improved locking member for locking the cable assembly with a complementary connector.

To achieve the above object, a cable end connector assembly in accordance with the present invention comprises an insulative housing, a plurality of contacts received in the insulative housing, a plurality of cables comprising a plurality of conductors electrically connecting with corresponding contacts, a pair of covers assembled on the rear portion of the housing and enclosing front portions of the cables together, and a pair of locking members. The insulative housing defines a forwardly extending mating port with a pair of opposite side portions by two sides thereof, each of said side portions defining a first retention cavity; each cover defines a pair of opposite side portions with a pair of U-shaped second retention cavities therein, respectively, the first retention cavities aligned with the corresponding second retention cavities in a front-to-back direction; the locking members received in the second retention cavities of the covers and extending into the first retention cavities of the housing, each locking members comprising a spring section and a latching section, the spring section is movable received in the second retention cavities; the covers are engaged together by a plurality of screws.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
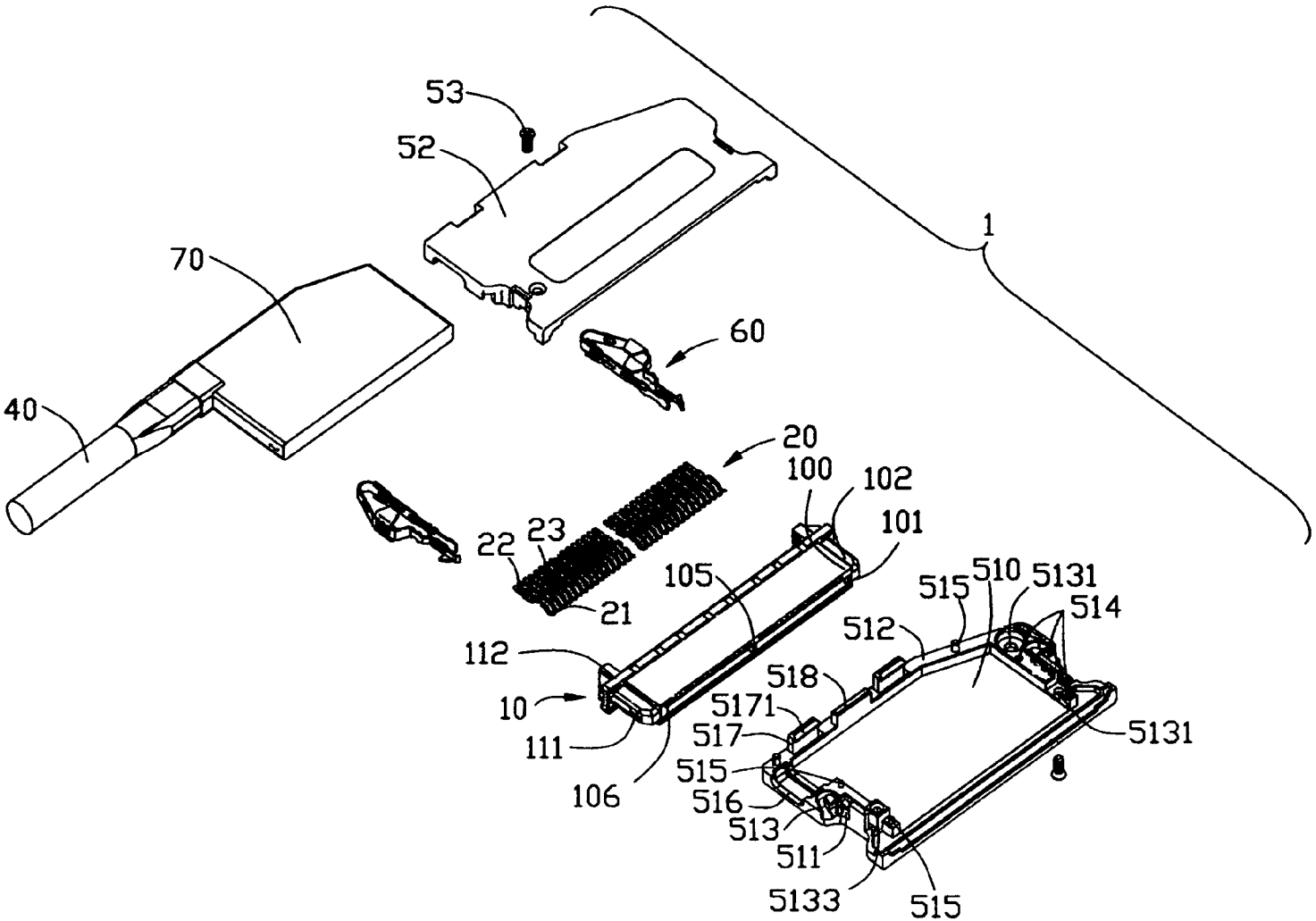
FIG. 1 is a partially exploded, perspective view of a cable assembly in accordance with the present invention.

Referring to FIGS. 1 to 4, a cable assembly 1 in accordance with the present invention comprises an insulative housing 10, a plurality of contacts 20, a plurality of cables 40, an insulator 70, a cover 50 and a pair of locking members 60. In the present embodiment, the cable assembly 1 is in accordance with a Serial ATA II standard. However, in alternative embodiments, the electrical connector could be provided as other types.

Figure 2:
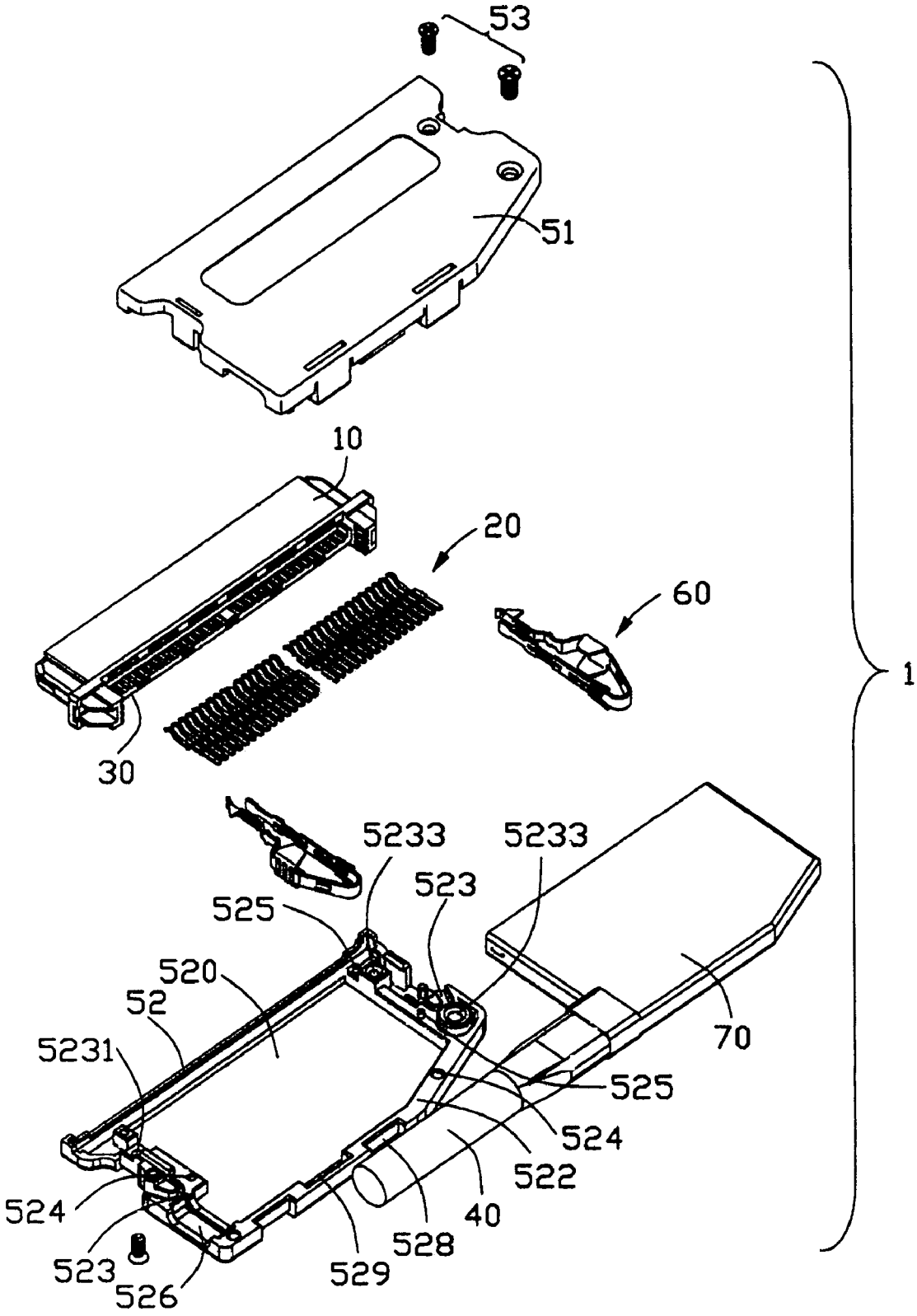
FIG. 2 is a view similar to FIG. 1, but taken from a different aspect.
Figure 3:
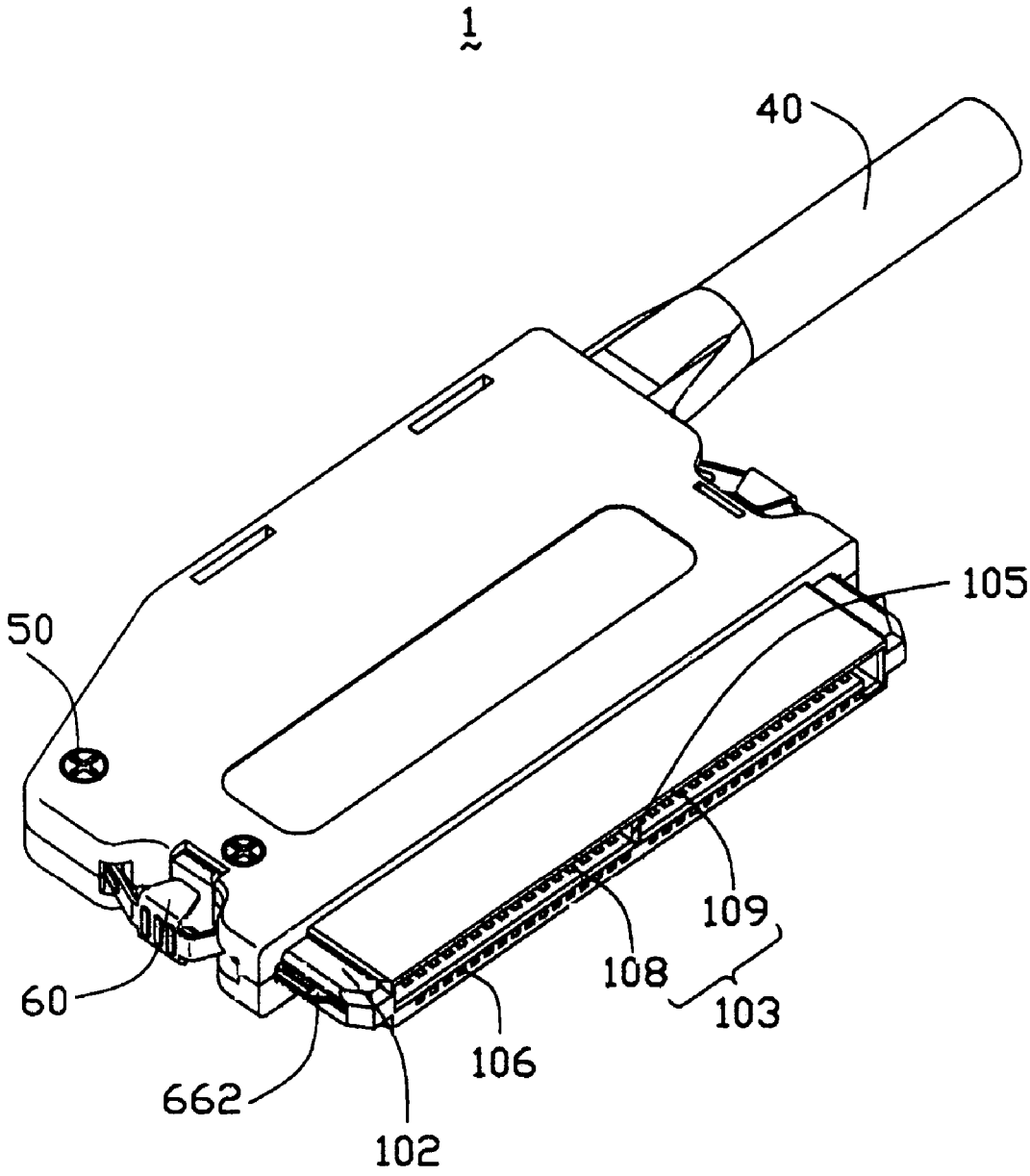
FIG. 3 is an assembled, perspective view of the cable assembly of FIG. 1.
Figure 4:
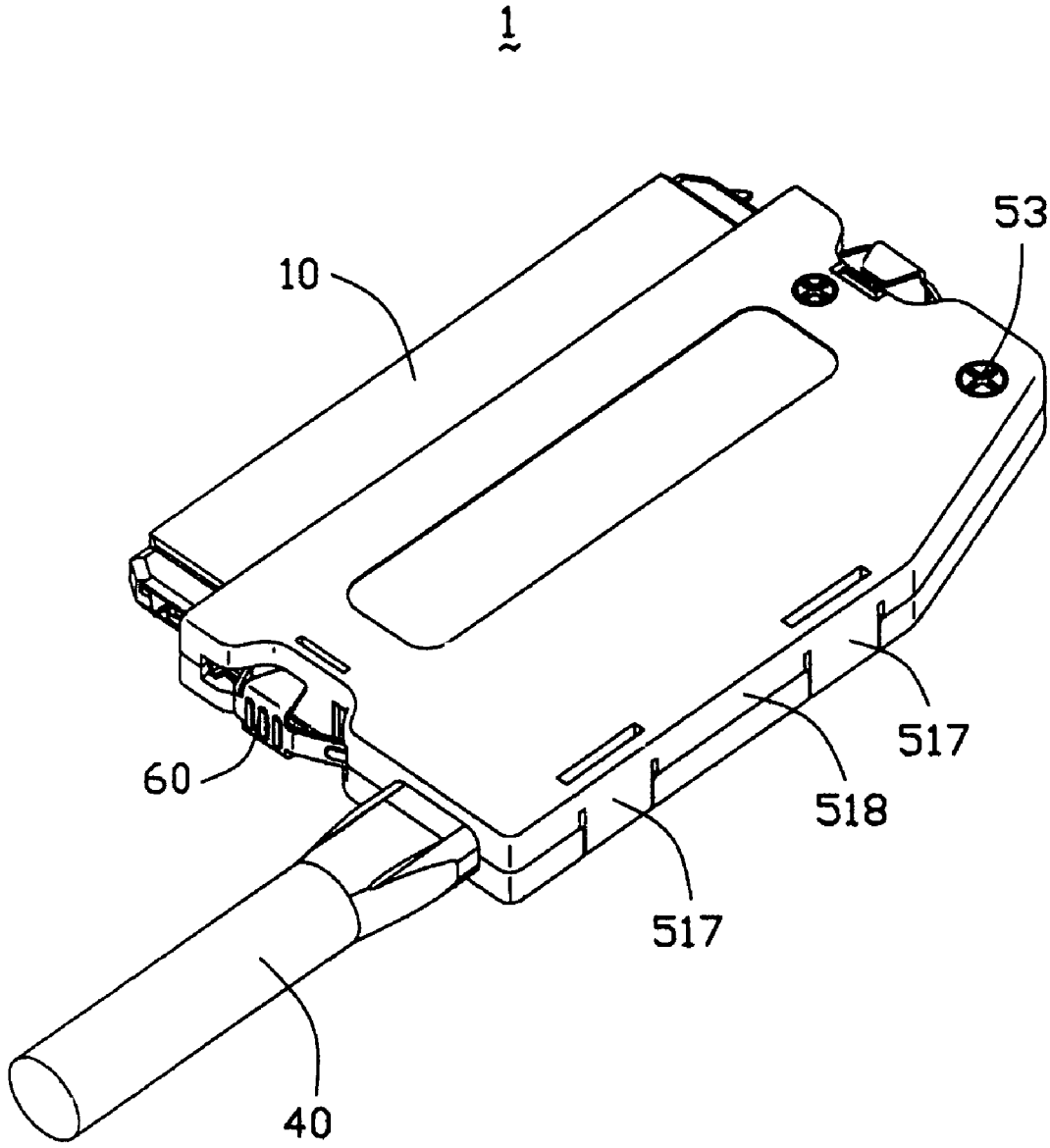
FIG. 4 is a view similar to FIG. 3, but taken from a different aspect.
Figure 5:
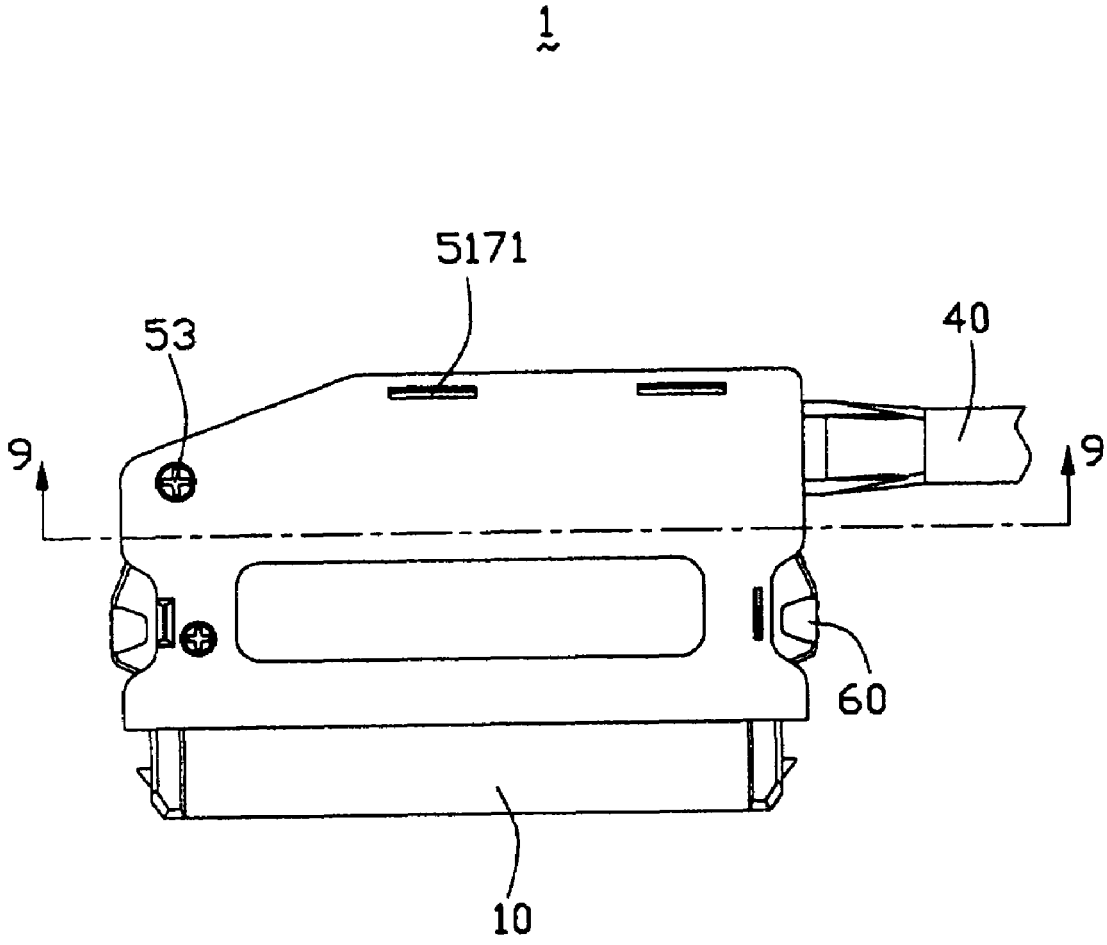
FIG. 5 is a top elevation view of the cable assembly.
Figure 6:
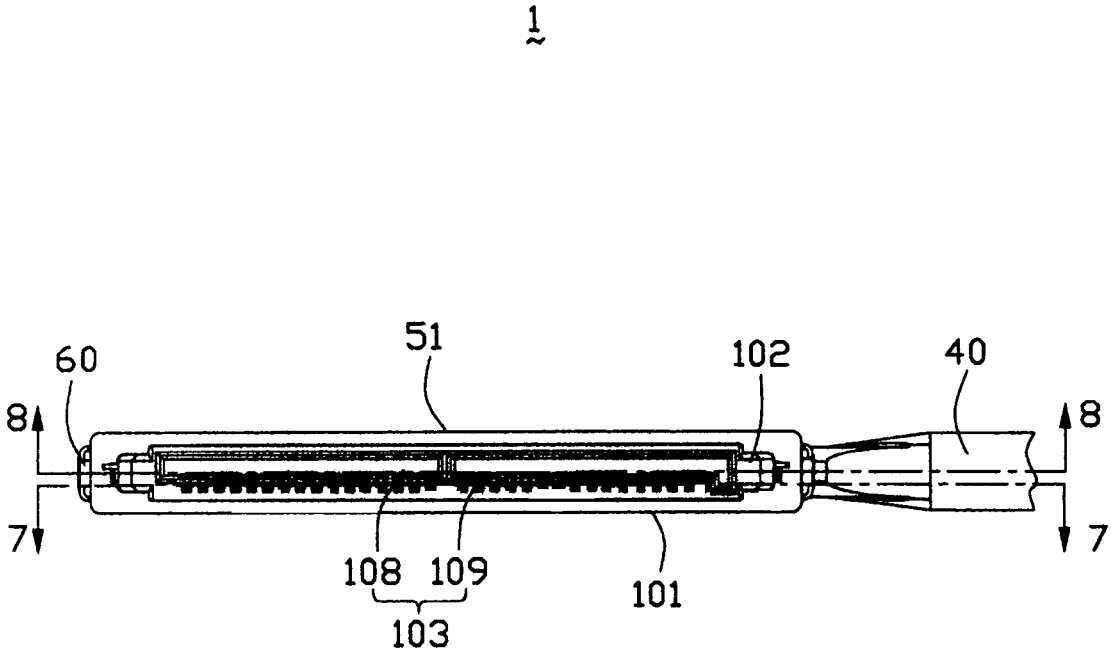
FIG. 6 is a front elevation view of the cable connector assembly.

Particularly referring to FIGS. 1 to 3, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a front plug receiving space 103 and a rear spacer receiving space (not shown) for respectively receiving a complementary connector (not shown) and the spacer 30. A block 105 is formed on the upper wall 100 and protrudes into the plug receiving space 103. The block 105 defines a plurality of passageways 106 extending therethrough in a front-to-back direction and communicating with the plug receiving space 103. The plug receiving space 103 is divided into an L-shaped first port 108 and a rectangular second port 109 by a vertically extended partition wall (not labeled) for receiving complementary connectors with different profiles. Each side portion 102 defines a retention cavity 111 opening toward outside therein for engaging with corresponding locking member 60.

Referring to FIGS. 1 to 3, the contacts 20 are received in the passageways 106 of the insulative housing 10 and each contact comprises a curved contact portion 21, a tail portion 22 and a housing retaining portion 23 connecting the contact portion 21 and the tail portion 22. The contact portions 21 extend into the L-shaped first port 108 and the rectangular second port 109 and partially exposed into the plug receiving space 103 of the housing 10, respectively. The housing retaining portions 23 are secured within the passageways 106 of the housing 10 by an interference fit.

The insulator 70 is over-molded the cable 40 and received in the cover 50. The cable 40 extends outwardly from a lateral edge of the insulator 70 to present L-shape. The angle between the cable 40 and the insulator 70 can be adjusted according to the requirement.

Referring to FIGS. 1, 2, and 7-9, the cover 50 comprises an upper cover 51 and a lower cover 52. The upper cover 51 is of a sandglass-like configuration and comprises a body portion 510, a rear edge 512 projecting outwardly from rear end of the body portion 510, and a pair of side portions 511 at the opposite lateral ends of the body portion 510. Each side portion 511 comprises a substantially U-shaped receiving cavity 513 in a middle area thereof. A first side portion 511 defines a pair of screw-holes 5131 disposed along the front-to-back direction, and a plurality of positioning holes 514 therein. An opening 516 is defined in the second side portion 513 and adjacent to the rear edge 512. The second side portion 513 defines a screw post 5133 with a passage therein (not labeled), and a plurality of positioning posts 515 thereon. The rear edge 512 of the upper cover 51 comprises a straight edge section and an inclined edge section. The rear edge 512 forms a plurality of positioning posts 515 spaced arranged the straight and inclined edge sections thereon, a pair of plastic latches 517 respectively extending from the straight edge portion thereof with a hook 5171 at each distal end, and a protrusion 518 formed between the plastic latches 517. The rear edge 522 defines a plurality of positioning hole 524, a pair of receiving channels 529, and a receiving passageway 528 between the receiving channels 529.

During the upper and the lower covers 51, 52 are assembled together, the plastic latches 517 are inserted into corresponding receiving channels 519, and the hooks 5171 engage with the outer face of the lower cover 52. The protrusion 518 is received in the receiving passageway 528 for guiding insertion and position. The opening 516, 526 of the upper and lower covers 51, 52 together forms an existing opening (not labeled) for the cable 40's existance. Each positioning posts 525, 515 of the lower cover and the upper cover 52, 51 are inserted into corresponding positioning holes 514, 524 of the upper cover and lower covers 51, 52. Each screw post 5133, 5233 of the upper and lower covers 51, 52 is inserted into corresponding screw hole 5131, 5231 for letting a screw 53 go through. The upper and the lower covers 51, 52 are retained with each other by the screws 53. The U-shaped receiving cavities 513, 523 on the upper cover 51 and the lower cover 52 together define a second retention cavity 55 (FIG. 9) communicating with the first retention cavities 111 of the insulative housing 10 along the front-to-back direction.

Figure 10:
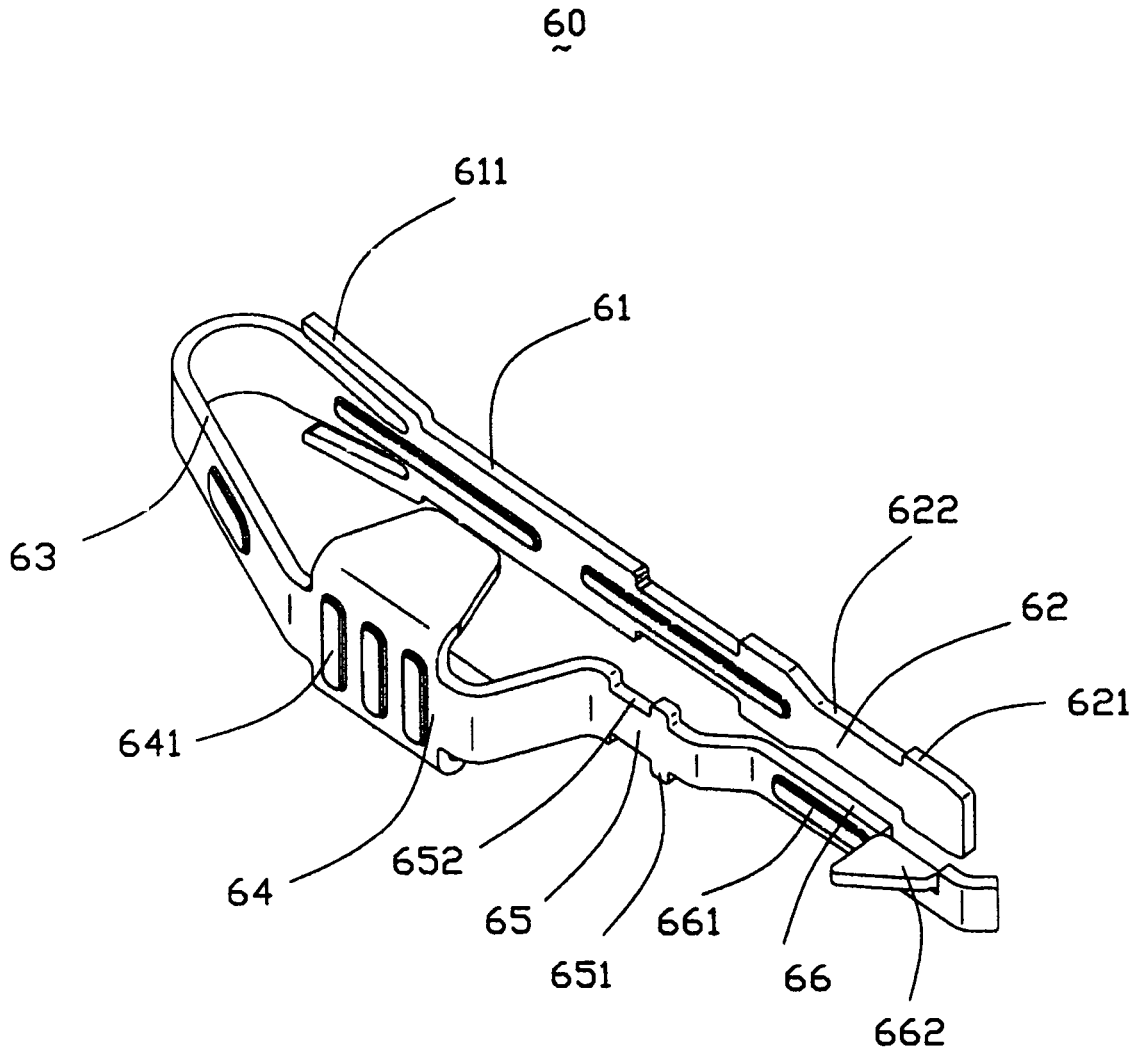
FIG. 10 is an enlarged view of a locking member shown in FIG. 1.
Figure 11:
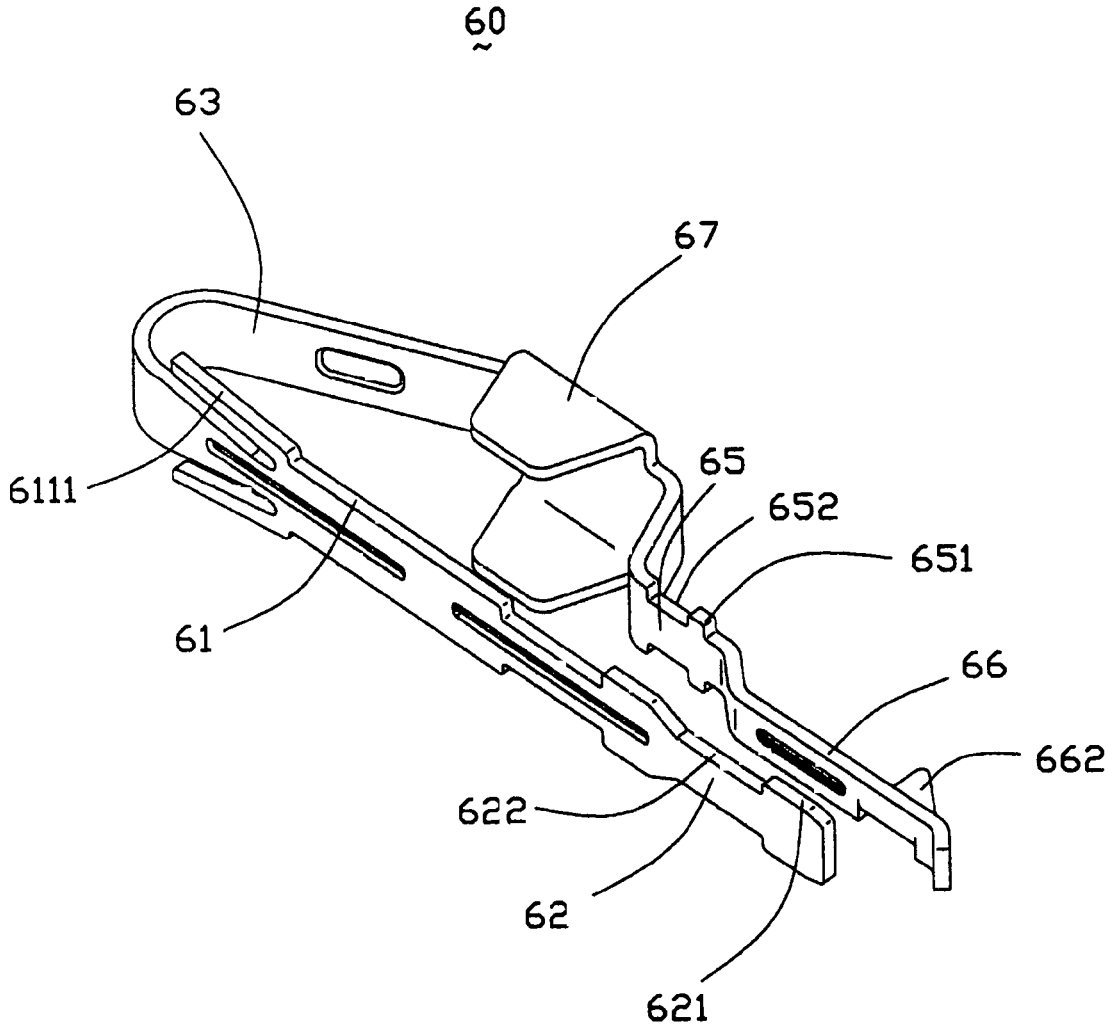
FIG. 11 is a view similar to FIG. 10, but taken from a different aspect.

Referring to FIGS. 10 and 11, each locking member 60 is stamped and formed from a metallic plate and comprises an elongate, housing retention section 62 extending along the front-to-back direction, a cover retention section 61 extending rearwardly from the housing retention section 62, a spring section 63 extending slantways from the cover retention section 61, a flat pushing section 64 extending forwardly from the spring section 63, an L-shaped positioning section 65 extending forwardly from the pushing section 64, and a latch section 66 extending forwardly from the positioning section 65. The housing retention section 62 are partially cut to form two pairs of recesses 622, thus, also forming a pair of retention tabs 621 at middle and a tip end thereof. The cover retention section 61 defines a pair of retention tabs 611 slantways extending from opposite upper and lower edges thereof for engaging with the cover 50. The pushing section 64 defines a plurality of protrusions 641 on an outer surface thereof for handling concentrically. A pair of stopping sections 67 extends towards the cover retention section 61 from opposite sides of the pushing section 64. The positioning section 65 comprises a pair of positioning tabs 651 and a pair of recesses 652 for assuring fixed assembly. The latch section 66 comprises a protrusion 661 outwardly protruding from outer surface thereof along the front-to-back direction and a locking tab 662 bent and extending outwardly.

Figure 7:
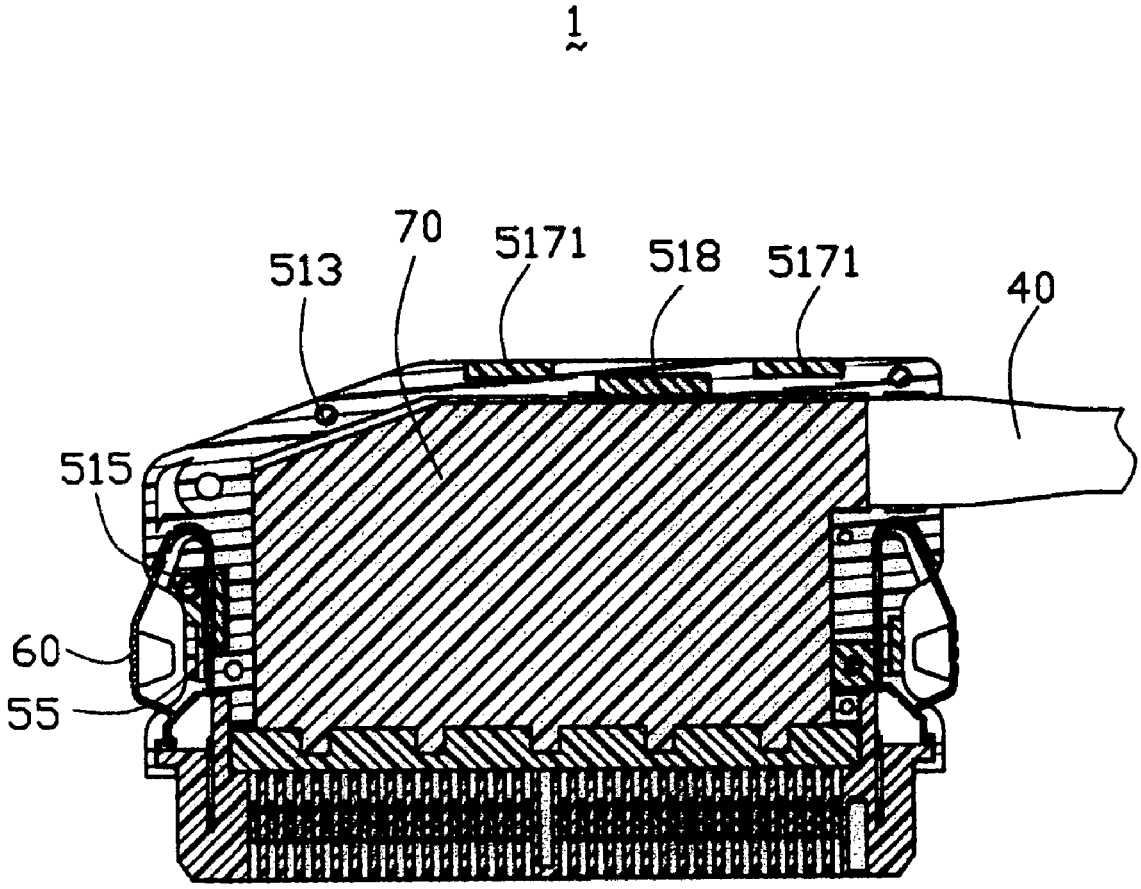
FIG. 7 is a cross-sectional view taken along line 7-7 of FIG. 5.
Figure 8:
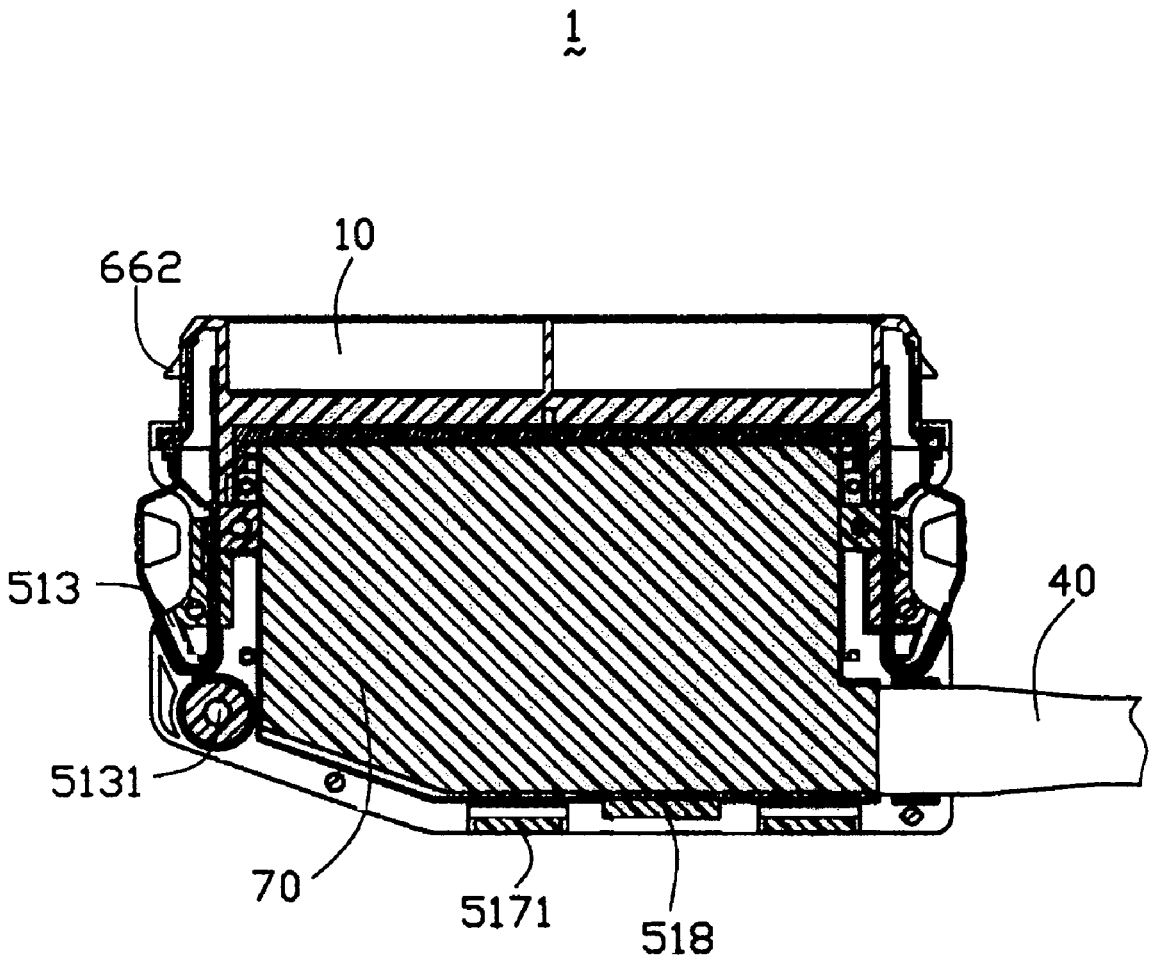
FIG. 8 is a cross-sectional view taken along line 8-8 of FIG. 4
Figure 9:
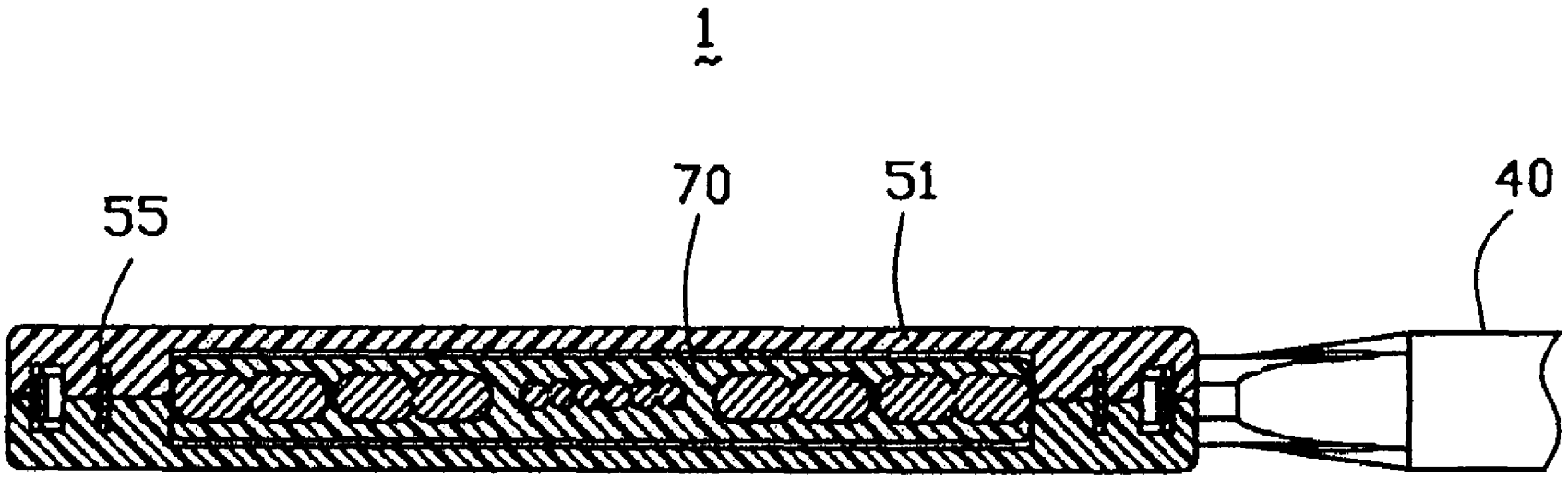
FIG. 9 is a cross-sectional view taken along line 9-9 of FIG. 6.

Referring to FIGS. 7 to 9, in assembly, the wires of the cable 40 electrically connect with the tail portions 23 of the contacts 20. The upper and lower covers 51, 52 enclose a front portion of the housing 10, the insulator 70, and the front portion of the cable 40 with extending out of the cover 50 from the opening (not labeled) at the lateral side of the cover 50. The locking members 60 are assembled on the opposite ends of the housing 10 and the cover 50. The housing retention section 62 of the locking member 60 is received in the first retention cavity 111 of the housing 10 with the retention tabs 621 being engaged therein. The cover retention section 61 is received in the second retention cavity 55 of the cover 50 with the retention tabs 61 engaging with and securely retained in the cover 50. The pushing section 64 and the stopping section 67 are located in the depression (not labeled) of the cover 50, and the stopping sections 67 extends towards the cover 50. The latch section 66 is received in the first retention cavity 111 of the housing 10 and the locking tab 662 projects outside the housing 10. When the cable assembly 1 mates with the complementary connector, an inward pressing force is firstly exerted on the pushing sections 64 of the locking members 60 by user's fingers to drive the latch section 66 to move inwardly to separate the cable assembly 1 from the complementary connector. Once the pressing force is released, the latch section 66 restore to its original position due to their own elasticity and thus locks with the complementary connector through the locking tab 622. The positioning tabs 651 of each positioning section 65 abut against the housing 10 for assuring a reliable mating between the cable end connector assembly 1 and the complementary connector. When the cable end connector assembly 1 is to be disengaged from the complementary connector, a contrary operating procedure is applied It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly mating with a complementary connector along a front-to-back direction, comprising:

an insulative housing defining a pair of first retention cavities;

a plurality of contacts disposed in the housing;

a cable extending along a left-to-right direction perpendicular to the front-to-back direction with a plurality of conductors electrically connecting with the contacts;

an insulator comprising a base and a distal portion extending from the base;

a pair of covers assembled on the rear portion of the housing, and defining a body portion, a receiving portion extending rearwardly from the body portion and a pair of opposite side portions with a pair of U-shaped second retention cavities therein, respectively, the base of the insulator being received in the body portion, and the distal portion of the insulator being received in the receiving portion, the first retention cavities aligned with the corresponding second retention cavities in the front-to-back direction; and a pair of locking members received in the second retention cavities of the covers and extending into the first retention cavities of the housing.

2. The cable assembly as described in claim 1, wherein the cable extends into the insulator along the left-to-right direction.

3. The cable assembly as described in claim 2, wherein the cover comprises an upper cover and a lower cover.

4. The cable end connector assembly as described in claim 3, wherein the upper and the lower cover are assembled on the housing along an up-to-down direction perpendicular to the front-to-back direction and the left-to-right direction.

5. The cable assembly as described in claim 4, wherein the upper and the lower covers are retained together by a screw.

6. The cable assembly as described in claim 5, wherein the upper cover comprises a body portion, and two side portions are formed at opposite sides of the body portion, each side portion comprises an U-shaped receiving cavity.

7. The cable assembly as described in claim 6, wherein the lower cover comprises a body portion, and two side portions form at opposite sides of the body portion, each side portion comprises an U-shaped receiving cavity, and the receiving cavities on the upper cover and lower cover are formed said second retention cavities.

8. The cable end connector assembly as described in claim 7, wherein the upper and lower cover comprises a positioning post and a positioning hole formed on respective inner surface and the positioning post extends into the positioning hole for position the upper and lower covers in right place.

9. The cable assembly as described in claim 8, wherein the side portions of the upper and the lower covers, each comprises a screw-hole, and said screws pass through the screw-holes on the upper and lower covers.

10. The cable assembly as described in claim 9, wherein the upper and the lower covers comprise a semi-circular opening, respectively, and forms a circular opening together for letting the cable extend out of the cover.

11. The cable assembly as described in claim 1, wherein the housing defines a receiving space therein and a partition wall extending along a longitudinal direction, the receiving space is divided by the partition wall into two ports.

12. The cable end connector assembly as described in claim 11, wherein one of the two ports of the housing is L-shaped.

13. The assembly as claimed in claim 1, wherein junctures end of the cable from the covers are located at a same height in a horizontal direction with a mating port of the housing.

14. A cable connector assembly comprising:

an insulative housing defining a mating port communicating with an exterior in a front-to-back direction;

a plurality of contacts disposed in the housing and exposed to the mating port;

a cable connected to a rear side of the housing and electrically connected to the corresponding contacts;

a cover including two halves commonly enclosing the cable and the housing, said cover essentially defining two long sides and two short sides with the mating port located on one of said long sides and with a passage defined in one of said two short sides through which the cable extends so as to allow the cable to extend in a transverse direction perpendicular to said front-to-back direction; wherein locking structures are integrally formed on the cover along the other of the long sides, and auxiliary fastening devices are applied on said two short sides.

15. The assembly as claimed in claim 14, wherein said auxiliary fastening devices are applied to the other one of said two short sides distal from the passage.

16. The assembly as claimed in claim 14, wherein juncture end of the cable from the cover is located at a same height in a horizontal direction with a mating port of the housing.

* * * * *